US012215584B2

(12) United States Patent
Alali et al.

(10) Patent No.: US 12,215,584 B2
(45) Date of Patent: Feb. 4, 2025

(54) METHOD AND SYSTEM FOR DETERMINING A GEOLOGICALLY-GUIDED ASSESSMENT FOR MANAGING DRILLING

(71) Applicant: SAUDI ARABIAN OIL COMPANY, Dhahran (SA)

(72) Inventors: Ammar Alali, Dhahran (SA); Mahmoud F. Abughaban, Dhahran (SA); Abdulaziz Hussain Al-Hasan, Dhahran (SA); Amjad Al-Makki, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 339 days.

(21) Appl. No.: 17/664,994

(22) Filed: May 25, 2022

(65) Prior Publication Data

US 2023/0383637 A1 Nov. 30, 2023

(51) Int. Cl.

| | |
|---|---|
| ***E21B 44/00*** | (2006.01) |
| ***E21B 45/00*** | (2006.01) |
| *E21B 12/02* | (2006.01) |

(52) U.S. Cl.

CPC ..... *E21B 44/00* (2013.01); *E21B 45/00* (2013.01); *E21B 12/02* (2013.01); *E21B 2200/20* (2020.05); *E21B 2200/22* (2020.05)

(58) Field of Classification Search

USPC ..... 702/9

See application file for complete search history.

(56) References Cited

U.S. PATENT DOCUMENTS

| | | | |
|---|---|---|---|
| 4,845,628 | A | 7/1989 | Gray et al. |
| 7,548,873 | B2 | 6/2009 | Veeningen et al. |
| 9,970,266 | B2 | 5/2018 | Marx et al. |
| 2002/0103630 | A1 * | 8/2002 | Aldred ..... E21B 44/00 703/10 |

(Continued)

OTHER PUBLICATIONS

M. Enamul Hossain; "Drilling Costs Estimation for Hydrocarbon Wells", Journal of Sustainable Energy Engineering; vol. 3; Issue 1; Mar. 25, 2019; pp. 3-32 (30 pages).

*Primary Examiner* — Paul D Lee

(74) *Attorney, Agent, or Firm* — Osha Bergman Watanabe & Burton LLP

(57) ABSTRACT

A method may include obtaining acquired drilling parameter data regarding a drilling parameter in real-time during a drilling operation for a predetermined well. The method may include determining, based on a drilling cost model, first drilling cost data using the acquired drilling parameter data. The method may include determining whether the first drilling cost data satisfies a predetermined criterion. The method may include determining, in response determining that the first drilling cost data fails to satisfy the predetermined criterion, a replacement component for the drilling operation. The method may include determining, based on the drilling cost model, second drilling cost data based on using the replacement component for the drilling operation. The method may include transmitting a command to update the drilling operation by changing a drilling system to use the replacement component in response to determining that the second drilling cost data satisfies the predetermined criterion.

14 Claims, 11 Drawing Sheets

(56) References Cited

U.S. PATENT DOCUMENTS

| | | | | |
|---|---|---|---|---|
| 2003/0220742 | A1* | 11/2003 | Niedermayr | E21B 44/00 702/9 |
| 2009/0076873 | A1* | 3/2009 | Johnson | G06Q 10/06 705/7.28 |
| 2014/0222527 | A1 | 8/2014 | Allison | |
| 2015/0310367 | A1 | 10/2015 | Kuesters et al. | |
| 2018/0298746 | A1 | 10/2018 | Short et al. | |
| 2019/0093468 | A1* | 3/2019 | Aguirre | E21B 44/00 |
| 2020/0149354 | A1* | 5/2020 | Singh | G06N 3/08 |
| 2020/0190961 | A1* | 6/2020 | Moss, Jr. | E21B 3/02 |
| 2021/0025269 | A1 | 1/2021 | Zaripov | |
| 2022/0316328 | A1* | 10/2022 | Srivastava | E21B 49/003 |

* cited by examiner

METHOD AND SYSTEM FOR DETERMINING A GEOLOGICALLY-GUIDED ASSESSMENT FOR MANAGING DRILLING

BACKGROUND

Drilling costs may be affected by many variables in a drilling operation, such as location and depth of a drilled well, manpower experience, and equipment efficiency. While drilling costs are often analyzed in the planning stages, unknown factors during a drilling operation may also contribute to dramatic changes in drilling costs that differ from earlier estimates.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes obtaining acquired drilling parameter data regarding a drilling parameter in real-time during a drilling operation for a predetermined well. The method further includes determining, by a computer processor and based on a drilling cost model, first drilling cost data using the acquired drilling parameter data. The first drilling cost data include a real-time cost of drilling the predetermined well at a current drilling rate in the drilling operation. The method further includes determining, by the computer processor, whether the first drilling cost data satisfies a predetermined criterion. The method further includes determining, by the computer processor and in response determining that the first drilling cost data fails to satisfy the predetermined criterion, a replacement component for the drilling operation. The method further includes determining, by the computer processor and based on the drilling cost model, second drilling cost data based on using the replacement component for the drilling operation. The method further includes transmitting a command to update the drilling operation by changing a drilling system to use the replacement component in response to determining that the second drilling cost data satisfies the predetermined criterion.

In general, in one aspect, embodiments relate to a system that includes a drilling system that includes various sensors and a drill string that includes a drill bit. The drilling system is coupled to a wellbore. The system further includes a control system coupled to the drilling system. The control system includes a computer processor. The control system obtains acquired drilling parameter data regarding a drilling parameter in real-time during a drilling operation for a predetermined well associated with the wellbore. The control system further determines, based on a drilling cost model, first drilling cost data using the acquired drilling parameter data. The first drilling cost data include a real-time cost of drilling the predetermined well at a current drilling rate in the drilling operation. The control system further determines whether the first drilling cost data satisfies a predetermined criterion. The control system further determines, in response determining that the first drilling cost data fails to satisfy the predetermined criterion, a replacement component for the drilling operation. The control system further determines, based on the drilling cost model, second drilling cost data based on using the replacement component for the drilling operation. The control system further transmits a command to update the drilling operation by changing a drilling system to use the replacement component in response to determining that the second drilling cost data satisfies the predetermined criterion.

In general, in one aspect, embodiments relate to a method that includes obtaining acquired drilling parameter data regarding a drilling parameter in real-time during a drilling operation for a predetermined well. The method further includes determining, by a computer processor and based on a drilling cost model, first drilling cost data using the acquired drilling parameter data. The first drilling cost data include a real-time cost of drilling the predetermined well at a current drilling rate in the drilling operation. The method further includes determining, by the computer processor, whether the first drilling cost data satisfies a predetermined criterion. The method further includes determining, by the computer processor and in response determining that the first drilling cost data fails to satisfy the predetermined criterion, a replacement component for the drilling operation. The method further includes determining, by the computer processor and based on the drilling cost model, second drilling cost data based on using the replacement component for the drilling operation. The method further includes transmitting a command to terminate the drilling operation in response to determining that the second drilling cost data fails to satisfy the predetermined criterion.

In some embodiments, acquired drilling parameter data correspond to a first drill bit operating at a predetermined rate of penetration (ROP). The replacement component may be a second drill bit that is different from the first drill bit. The second drilling cost data may correspond to the second drill bit operating at the predetermined ROP. In some embodiments, the predetermined criterion corresponds to a predetermined cost-per-length of a first drilling run in a well path. The well path may be produced by the drilling operation using various drilling runs that include the first drilling run. In some embodiments, historical well data are obtained for one or more wells at a predetermined distance from the predetermined well. The drilling cost model may use the historical well data to determine the predetermined criterion. In some embodiments, third drilling cost data are determined based on the drilling cost model and using second acquired drilling parameter data that is obtained in real-time during the drilling operation. A second command may be transmitted to terminate the drilling operation in response to determining that the third drilling cost data fails to satisfy the predetermined criterion. In some embodiments, third drilling cost data are determined based on the drilling cost model and using second acquired drilling parameter data that is obtained in real-time during the drilling operation. An adjusted drilling parameter may be determined based the second acquired drilling parameter data, the one or more drilling parameters, and the third drilling cost data. A second command may be transmitted to the drilling system that adjusts the drilling operation based on the adjusted drilling parameter. In some embodiments, directional drilling cost data are obtained for the drilling operation. The first drilling cost data may be determined using the drilling cost model and the directional drilling cost data. In some embodiments, rig cost data are obtained for a drilling rig that performs a drilling operation. The first drilling cost data may be determined using the drilling cost model and the rig cost data. In some embodiments, a drilling cost model is an artificial neural network that includes an input layer, various hidden layers, and an output layer.

In some embodiments, a user device is coupled to the control system. The user device may provide a graphical user interface for presenting drilling cost data. In some embodiments, a predetermined criterion is a targeted cost-per-foot drilling rate for a drilling operation. The user device may present that drilling cost data is worse than a targeted cost-per-foot drilling rate. The user device may obtain a user selection of a replacement component in response to presenting the drilling cost data is worse than the targeted cost-per-foot drilling rate. In some embodiments, a mud pump system is coupled to the control system and the wellbore. The mud pump system may supply a first drilling fluid to the wellbore. The replacement component may be a second drilling fluid that is different from the first drilling fluid. In some embodiments, the first acquired drilling parameter data corresponds to a first drill bit operating at a predetermined rate of penetration (ROP).

In light of the structure and functions described above, embodiments disclosed herein may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
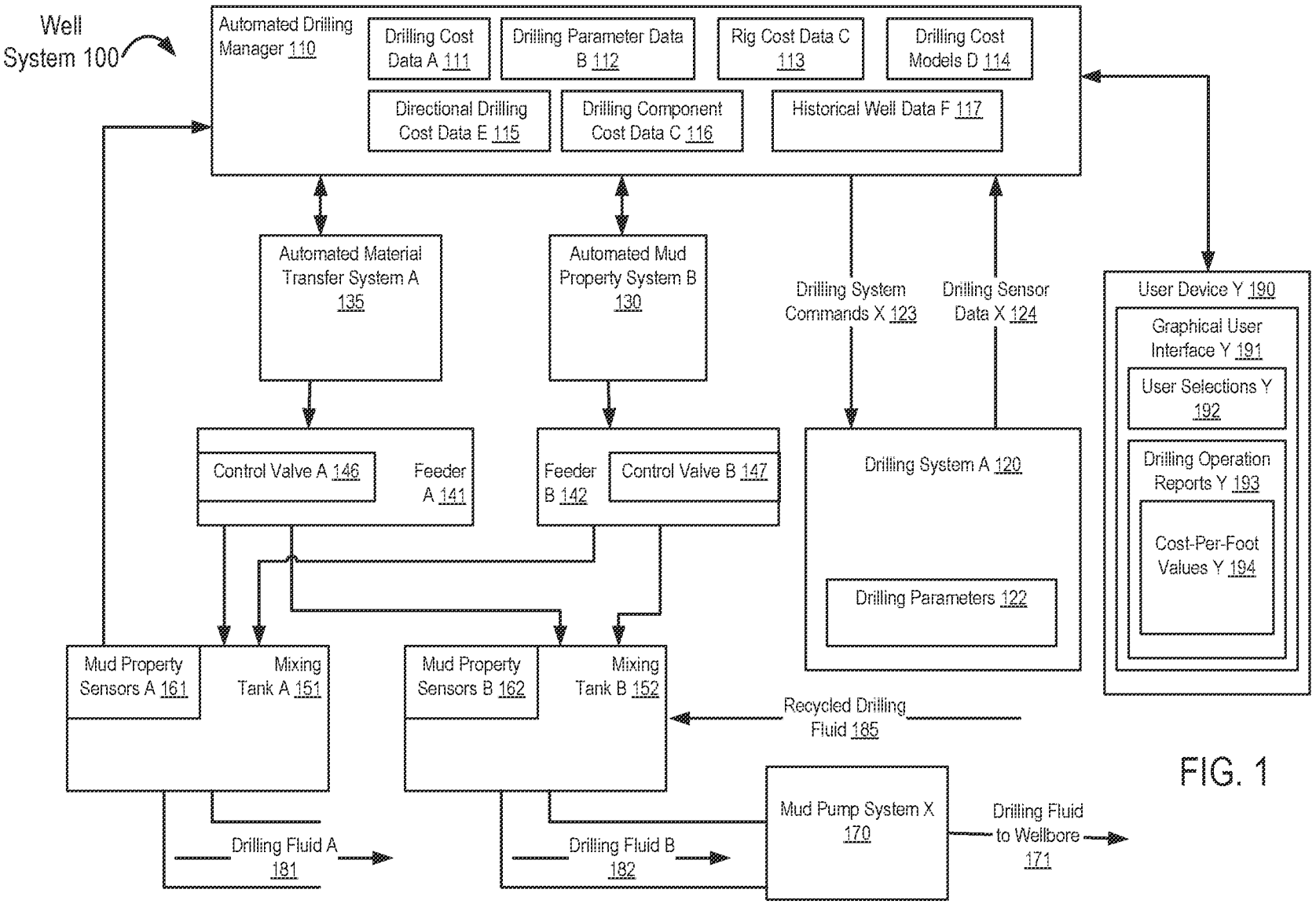
FIGS. 1 and 2 show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for determining changes in drilling costs data in real-time during a drilling operation. In some embodiments, drilling cost data (e.g., the cost-per-foot (CPF) of drilling a portion of a wellbore) may be analyzed in real-time, e.g., using a user device or an automated drilling manager, in order to optimize the performance of the drilling operation. In particular, drilling cost data may quantify the economics and drilling performance (e.g., drill bit performance) when drilling long sections of a well path. In the case of drill bits, a drilling operation may require replacing multiple drill bits in a drill string to complete a well path. Rather than calculating average costs after a particular drilling run, decisions may be made automatically in real-time to select the best drilling components (e.g., the best drill bit) and quantify changes with respect to any predetermined criterion (e.g., target drilling costs for a particular section).

Furthermore, some embodiments enable benchmarking current drilling costs with respect to historical performance at similar wells. For example, historical wells may be selected based on historical well data (e.g., historical well data F (117)) that describes geological formations, hole sizes, location of wells, type of drilling mode for the respective well, and bit types used. Thus, drilling performance may be assessed during a drilling run (e.g., notifying drillers of an increasing CPF, a decreasing CPF, or a constant CPF). Real-time results may be compared with target drilling costs as such. Accordingly, drilling cost data may be used to determine whether to continue drilling with a selected bottomhole assembly or to initiate a pull-out-of-hole operation to replace a drill bit or other drilling components. By accounting for bit size, bit type, bit IADC classification, bit cost, rig hourly cost and directional drilling bottomhole assembly (BHA) hourly cost in real time, a user may monitor changes in cost trends in comparison with estimated costs and select different drilling components or drilling parameters based on the cost trends.

Turning to FIG. 1, FIG. 1 shows a schematic diagram in accordance with one or more embodiments. As shown in FIG. 1, FIG. 1 illustrates a well system (100) that may include an automated drilling manager (e.g., automated drilling manager (110)) coupled to one or more user devices (e.g., user device (190)), a drilling system (e.g., drilling system A (120)), a mud pump system (e.g., mud pump system X (170)), an automated material transfer system (e.g., automated material transfer system A (135)), an automated mud property system (e.g., automated mud property system B (130)), and various drilling fluid processing components. For example, drilling fluid processing equipment may include one or more feeders (e.g., feeder A (141), feeder B (142)), one or more control valves (e.g., control valve A (146), control valve B (147)), one or more mixing tanks (e.g., mixing tank A (151), mixing tank B (152)), and a solid removal system. An automated mud property system may include hardware and/or software that includes functionality for monitoring and/or controlling various chemical components used to produce drilling fluid. Likewise, the automated drilling manager may include hardware and/or software for monitoring and/or controlling one or more drilling operations performed by a drilling system.

With respect to the drilling system, drilling fluid may circulate through a drill string for continuous drilling, e.g., drilling fluid A (181) and drilling fluid B (182) as shown in FIG. 1, in order to circulate through a wellbore (e.g., drilling fluid to wellbore (171)). In particular, the ability of the drilling fluid to carry drilled cuttings from a wellbore may be governed by several factors that relate to various drilling fluid properties (e.g., mud rheology, mud weight, etc.) and various drilling operation parameters (e.g., drilling parameters (122)) such as drill pipe rotary speed (RPM), pipe eccentricity (i.e. axial location of the drill pipe), hole inclination angle, and rate of penetration (ROP). Likewise, used drilling fluid from a wellbore may be passed through a solid removal system prior to entering a mixing tank or being sent to a mud pump system. More specifically, a solid removal system may include equipment and other hardware for removing particular solids, such as drill cuttings and coarse aggregates, from used drilling fluid in order to recycle drilling fluid (e.g., recycled drilling fluid (185)). For more information on drilling systems, see FIG. 2 and the accompanying description below.

Furthermore, drilling fluid data (such as density data, lost circulation material (LCM) data, and mud velocity data) may correspond to different physical qualities associated with drilling mud, such as specific gravity values (also referred to as mud weight or mud density), viscosity levels, pH levels, rheological values such as flow rates, temperature values, resistivity values, mud mixture weights, mud particle sizes, mud pressures, mud velocities, and various other attributes that affect the role of drilling fluid in a wellbore. For example, a drilling fluid property may be selected by a user device to have a desired predetermined rheological value, which may include a range of acceptable values, a specific threshold value that should be exceeded, a precise scalar quantity, etc. As such, an automated drilling manager or another control system may obtain sensor data from various mud property sensors (e.g., mud property sensor A (161), mud property sensor B (162)) regarding various drilling fluid property parameters. Examples of mud property sensors include pH sensors, density sensors, rheological sensors, volume sensors, weight sensors, flow meters, such as an ES flow sensor, etc. Likewise, sensor data may refer to both raw sensor measurements and/or processed sensor data associated with one or more drilling fluid properties.

With respect to mud pump systems, a mud pump system (e.g., mud pump system X (170)) may include hardware and software with functionality for supplying drilling fluid to a wellbore at one or more predetermined pressures and/or at one or more predetermined flow rates. For example, a mud pump system may include one or more displacement pumps that inject the drilling fluid into a wellbore. Likewise, a mud pump system may include a pump controller that includes hardware and/or software for adjusting local flow rates and pump pressures, e.g., in response to a command from an automated drilling manager or other control system. For example, a mud pump system may include one or more communication interfaces and/or memory for transmitting and/or obtaining data over a well network. A mud pump system may also obtain and/or store sensor data from one or more sensors coupled to a wellbore regarding one or more pump operations. While a mud pump system may correspond to a single pump, in some embodiments, a mud pump system may correspond to multiple pumps.

With respect to mixing tanks, a mixing tank may be a container or other type of receptacle (e.g., a mud pit) for mixing various liquids, fresh mud, recycled mud (e.g., recycled drilling fluid (185)), additives, and/or other chemicals to produce a particular type of drilling fluid (e.g., drilling fluid A (181), drilling fluid B (182)). For example, a mixing tank may be coupled to one or more mud supply tanks, one or more additive supply tanks, one or more dry/wet feeders (e.g., feeder A (141), feeder B (142)), and one or more control valves (e.g., control valve A (146), control valve B (147)) for managing the mixing of chemicals within a respective mixing tank. Control valves may be used to meter chemical inputs into a mixing tank, as well as release drilling fluid into a mixing tank. Likewise, a mixing tank may include and/or be coupled to various types of drilling fluid equipment not shown in FIG. 1, such as various mud lines, liquid supply lines, and/or other mixing equipment.

In some embodiments, a well system includes an automated material transfer system (e.g., automated material transfer system A (135)). In particular, an automated material transfer system may be a control system with functionality for managing supplies of bulk powder and other inputs for producing a preliminary mud mixture. For example, an automated material transfer system may include a pneumatic, conveyer belt or a screw-type transfer system (e.g., using a screw pump) that transports material from a supply tank upon a command from a sensor-mediated response. Thus, the automated material transfer system may monitor a mixing tank using weight sensors and/or volume sensors to meter a predetermined amount of bulk powder to a selected mixing tank.

Likewise, a well system may also include an automated mud property system (e.g., automated mud property system B (130)) to control the supply of various additives to a mixing tank. In some embodiments, for example, an automated mud property system may include hardware and/or software with functionality for automatically supplying and/or mixing weighting agents, buffering agents, rheological modifiers, and/or other additives until a mud mixture matches and/or satisfies one or more desired drilling fluid properties. Examples of weighting agents may include barite, hematite, calcium carbonate, siderite, etc. A buffering agent may be a pH buffering agent that causes a mud mixture to resist changes in pH levels. For example, a buffering agent may include water, a weak acid (or weak base) and salt of the weak acid (or a salt of weak base). Rheological modifiers may include drilling fluid additives that adjust one or more flow properties of a drilling fluid. One type of rheological modifier is a viscosifier, which may be an additive with functionality for providing thermal stability, hole-cleaning, shear-thinning, improving carrying capacity as well as modifying other attributes of a drilling fluid. Examples of viscosifiers include bentonite, inorganic viscosifiers, polymeric viscosifiers, low-temperature viscosifiers, high-temperature viscosifiers, oil-fluid liquid viscosifiers, organophilic clay viscosifiers, and biopolymer viscosifiers.

In some embodiments, an automated drilling manager include hardware and/or software with functionality for determining drilling cost data relating to a drilling operation. Drilling costs for a hydrocarbon well may be affected by five main categories: pre-spud costs, casing and cementing costs, rotating drilling costs, non-rotating costs, and trouble costs. Pre-spud costs may be associated with the rig size which is dependent on the hole diameter and depth as well as the longest casing string's length. The cost of casing and cementing may include casing and cementing materials and running them in place. Rotating drilling costs are encountered once the bit is rotating and are included in costs associated with the rate of penetration (ROP) such as drilling fluid and drill bits. Moreover, non-rotating costs may include costs when the drill bit is not rotating, such as costs that include tripping operations and well control. Lastly, well costs may also include trouble costs based on unplanned incidents which take place during a drilling operation such as stuck pipe, lost circulation, and well control problems. In contrast to other costs of a drilling operation, rotating-costs may represent an influencing factor that may increase or decreasing the overall cost of drilling. Multiple fixed costs may contribute to drilling costs, such as rig costs (e.g., based on rig cost data C (113)), directional drilling costs (e.g., based on directional drilling cost data E (115)), and various fix component costs (e.g., based on drilling component cost data C (116)).

Furthermore, drilling cost data may describe an advance cost estimate of a drilling operation at a particular formation. In some embodiments, the drilling cost data describes changes in real-time to costs relating to an ongoing drilling operation. More specifically, various cost-per-foot estimations processes may be performed at a planning stage, following a drilling operation, and in real-time during a drilling operation. When drilling costs data are determined prior to a drilling operation, some estimation methods may lack consistency from well-to-well and from driller-to-driller which may result in very different cost outcomes. Likewise, differences may be significant between estimated costs prior to a drilling operation and real costs from the actual drilling operation, such as through overestimation or underestimation. For example, planning stages of a drilling operation may not consider many factors ultimately relevant to actual drilling costs, such as unknown geological features and actual performance of drilling components, such as different drill bits.

In some embodiments, an automated drilling manager determines changes to a drilling operation in real-time based on drilling cost data. For example, based on changes to a cost-per-foot during a drilling run, an automated drilling manager may determine in real-time whether to change to a different drill bit. In some embodiments, for example, an automated drilling manager determines a new drill bit for the ongoing drilling operation based on a hole size of a wellbore, different types of drill bits available for a drilling operation, parameters relating to a drilling system, and a rate of penetration record per run, and various properties relating to drilling fluids. A "drilling run" may refer to a portion of a drilling operation where a bottomhole assembly may enter a wellbore for drilling until the bottomhole assembly is removed from the wellbore. In some embodiments, drilling cost data is determined using the following equation:

$$CPF = \frac{\text{Bit cost (\$)} + \text{rig hourly rate}\left(\frac{\$}{\text{hr}}\right) * (\text{drilling hours} + \text{tripping hours})}{\text{Drilled footage (ft)} + \text{Directional Drilling Rate}\left(\frac{\$}{\text{ft}}\right)} \quad \text{Equation 1}$$

where the bit cost is the cost of a new replacement bit or a depreciated value of the current bit, rig hourly rate is a cost of a drilling rig, drilling hours correspond to a predetermined number of hours to complete a drilling operation, anticipated tripping hours corresponds to a predetermined number of hours for a tripping operation (e.g., by assuming a tripping speed of 1000 feet per hour), drilled footage corresponds to a length along a well path, and directional drilling rate corresponds to additional costs for a directional section of a well path.

In some embodiments, an automated drilling manager includes functionality for using one or more drilling cost models (e.g., drilling cost models D (114)) to determine drilling cost data (e.g., drilling cost data A (111)). More specifically, a drilling cost model may characterize actual and/or predicted drilling costs for a particular drilling operation based on geological factors, drilling factors, and other input data. For example, a drilling cost model may be used to determine instantaneous costs in real-time (e.g., the marginal cost of drilling another foot in a well path in an ongoing drilling operation or costs associated with a particular section of a well path or a drilling run) of a drilling operation. Furthermore, drilling cost models may describe relative costs, such as whether the cost of drilling a well is increasing, decreasing, or remaining the same. Where different formations may require different amounts of time to traverse in a well path, a drilling cost model may provide drilling cost data reflecting changes in drilling costs due to changes in one or more drilling components. Where a drill bit has prematurely worn down during a drilling operation, for example, the less efficient drill bit may become reflected in updated drilling cost data.

In some embodiments, an automated drilling manager transmits one or more commands (e.g., drilling system commands X (123)) to various control systems in a well system (e.g., drilling system A (120), automated material transfer system A (135), automated mud property system B (130)) in order to produce drilling operations with specific drilling parameters. For example, drilling parameters may include specific drilling fluid properties, such as predetermined density values or mud velocity values of a drilling fluid (e.g., drilling fluid A (181), drilling fluid B (182), recycled drilling fluid (185)). Likewise, drilling parameters data (e.g., drilling parameter data B (112)) may also include data that describes drill string properties, such as a specific weight-on-bit or rate of penetration (ROP) values. Commands may include data messages transmitted over one or more network protocols using a network interface, such as through wireless data packets. Likewise, a command may also be a control signal, such as an analog electrical signal, that triggers one or more operations in a particular control system (e.g., drilling system A (120)).

Furthermore, an automated drilling manager may monitor various drilling fluid properties and drilling parameters in real-time. For example, drilling fluid properties may be monitored using one or more mud property sensors. Likewise, drilling parameters may be modified in real-time based on downhole sensors, drilling sensors (e.g., using drilling sensor data X (124)), etc. In some embodiments, for example, the automated drilling manager modifies drilling parameters at predetermined intervals until user-defined properties are achieved by the well system (100). The user-defined properties may correspond to a selection by a user device (e.g., user selection Y (192) obtained by user device Y (190) using a graphical user interface Y (191)). For example, an automated drilling manager may be coupled to a user device e.g., over a well network, or remotely (e.g., through a remote connection using Internet access or a wireless connection at a well site). Based on real-time updates received for a current drilling operation, a user and/or the automated drilling manager may modify previously-selected drilling parameters, e.g., in response to changes in a drill bit while drilling or drilling fluid within the wellbore.

Keeping with FIG. 1, an automated drilling manager, an automated material transfer system, and/or an automated mud property system may include one or more control systems that include one or more programmable logic controllers (PLCs). Specifically, a programmable logic controller may control valve states, fluid levels, pipe pressures, warning alarms, and/or pressure releases throughout a well system. In particular, a programmable logic controller may be a ruggedized computer system with functionality to withstand vibrations, extreme temperatures, wet conditions, and/or dusty conditions, for example, around a drilling rig. In some embodiments, the automated drilling manager (110), the automated material transfer system A (135), the automated mud property system B (130), and/or the user device (190) may include a computer system that is similar to the computer system (702) described below with regard to FIG. 7 and the accompanying description.

During some well operations, a lost circulation event may occur that results in a partial or complete loss of drilling fluid and/or cement slurry into a formation. For example, a lost circulation event may be brought on by natural causes or induced causes within the formation. Natural causes may include naturally-occurring fractures or caverns adjacent to a wellbore as well as unconsolidated zones. Induced causes may include a situation when a hydrostatic fluid pressure exceeds a fracture gradient of the formation resulting in a fracture receiving fluid rather than resisting the fluid. When drilling into highly fractured formations, for example, severe fluid losses may be encountered that pose serious threats to drilling operations. Fluid losses may lead to various risks such as high costs of replacing drilling fluid during the drilling operation, formation damage left behind by lost circulation treatments, and even a possible loss of hydrostatic pressure that can cause an influx of gas or fluid, e.g., resulting in a well blowout.

With respect to drilling operations, various types of lost circulation material (LCMs) may be used in a lost circulation treatment to prevent or reduce drilling fluids from being lost inside downhole formations. LCM examples may include fibrous materials (e.g., cedar bark, shredded cane stalks, mineral fiber, and hair), flaky materials (e.g., mica flakes, pieces of plastic, and cellophane sheeting) or granular materials (e.g., ground and sized materials such as limestone, marble, wood, nut hulls, Formica, corncobs, and cotton hulls). A fibrous LCM may include long, slender and flexible substances that are insoluble and inert, where the fibrous material may assist in retarding drilling fluid loss into fractures or highly permeable zones. A flaky LCM may be thin and flat in shape with a large surface area in order to seal off fluid loss zones in a wellbore and help stop lost circulation. A granular LCM may be chunky in shape with a range of particle sizes. LCMs may also include one or more bridging agents that may include solids added to a drilling fluid to bridge across a pore throat or fractures of an exposed rock thereby producing a filter cake to prevent drilling fluid loss or excessive filtration. Example bridging agents may include removable-common products include calcium carbonate (acid-soluble), suspended salt (water-soluble) or oil-soluble resins. In some embodiments, granular materials, flaky materials, and/or fibrous materials are combined into an LCM pill and pumped into a wellbore next to a zone experiencing fluid loss to seal the formation. Different types of LCM may have different costs. For example, bentonite may have a lower price than medium-grade mica or nut plug circulation materials.

In regard to automated mud processing systems, an automated mud processing system may include a controller coupled various feeders, various control valves, various mixing tanks, and/or a solid removal system for managing drilling fluid in a drilling operation. The controller may include hardware, such as a processor, coupled to various sensors around various well systems at a well site. With respect to a mixing tank, a mixing tank may be a container or other type of receptacle (e.g., a mud pit) for mixing various liquids, fresh mud, recycled mud, different types of LCMs, additives, and/or other chemicals to produce a particular drilling fluid mixture. For example, a mixing tank may be coupled to one or more mud supply tanks, one or more additive supply tanks, one or more dry/wet feeders, and one or more control valves for managing the mixing of chemicals within a respective mixing tank. Control valves may be used to meter chemical inputs into a mixing tank, as well as release drilling fluid into a mixing tank.

Figure 2:
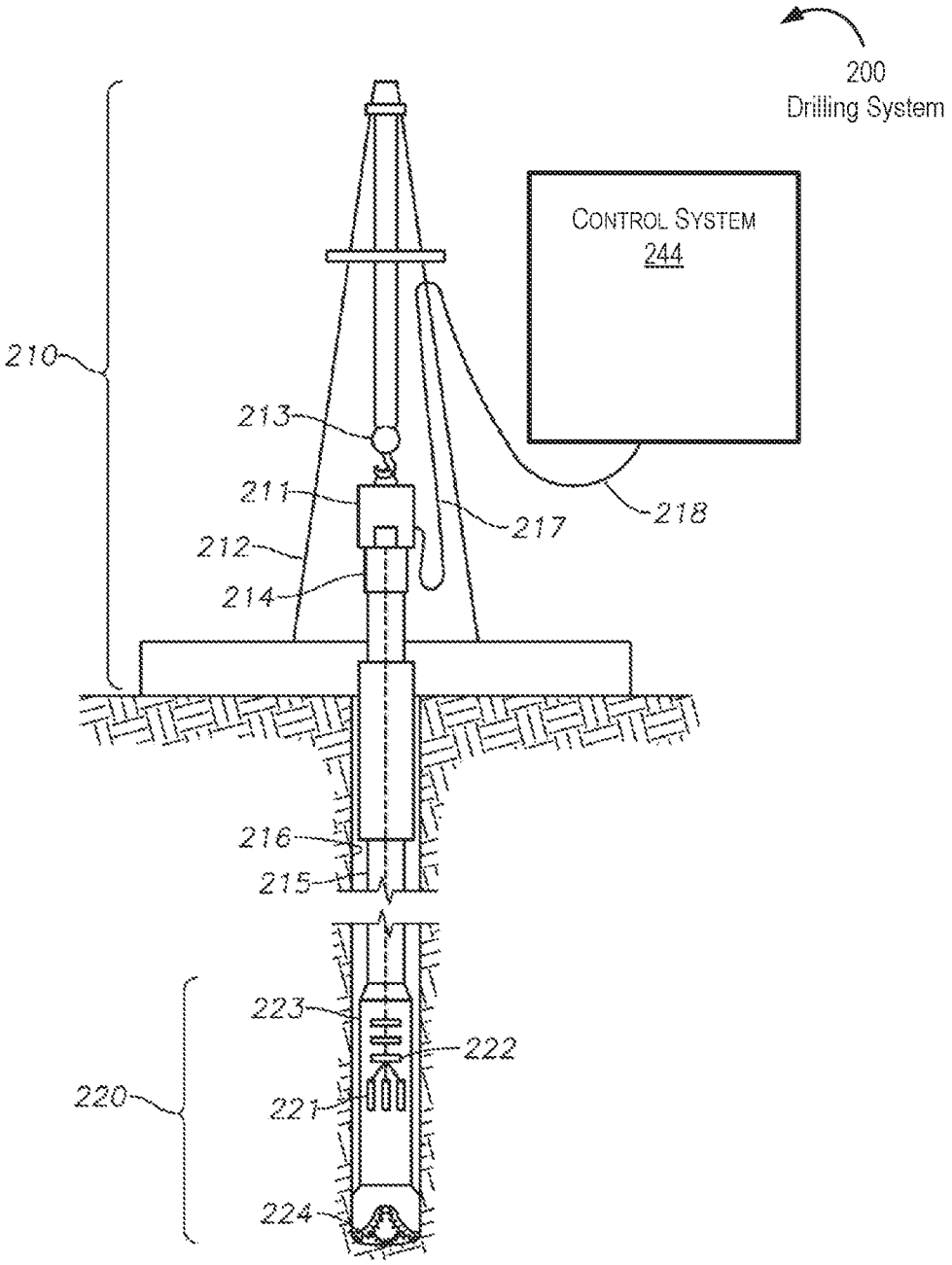

Turning to FIG. 2, FIG. 2 illustrates a system in accordance with one or more embodiments. As shown in FIG. 2, a drilling system (200) may include a top drive drill rig (210) arranged around the setup of a drill bit logging tool (220). A top drive drill rig (210) may include a top drive (211) that may be suspended in a derrick (212) by a travelling block (213). In the center of the top drive (211), a drive shaft (214) may be coupled to a top pipe of a drill string (215), for example, by threads. The top drive (211) may rotate the drive shaft (214), so that the drill string (215) and a drill bit logging tool (220) cut the rock at the bottom of a wellbore (216). A power cable (217) supplying electric power to the top drive (211) may be protected inside one or more service loops (218) coupled to a control system (244). As such, drilling fluid may be pumped into the wellbore (216) using the drive shaft (214) and/or the drill string (215). Likewise, the drilling system may also include a mud pump, a mud line, mud pits, a mud return, and other components related to the circulation or recirculation of drilling fluid within the wellbore (216). The control system (244) may be similar to various control systems described above in FIG. 1 and the accompanying description, such as the automated drilling manager (110), the automated material transfer system A (135) and/or the automated mud property system B (130).

In some embodiments, the drilling system (200) includes a bottomhole assembly (BHA). The bottomhole assembly may refer to a lower portion of the drill string (215) that includes a drill bit (224), bit sub (i.e., a substitute adapter), and a drill collar. The bottomhole assembly may also include a mud motor, stabilizers, heavy-weight drillpipe, jarring devices ("jars"), crossovers for various threadforms, directional drilling and measuring equipment, measurements-while-drilling tools, logging-while-drilling tools and other specialized devices. The bottomhole assembly may produce force for the drill bit to break rock and provide the drilling system with directional control of a wellbore. Different types of bottomhole assemblies may be used, such as a rotary assembly, a fulcrum assembly, and a pendulum assembly.

Moreover, when completing a well, casing may be inserted into the wellbore (216). The sides of the wellbore (216) may require support, and thus the casing may be used for supporting the sides of the wellbore (216). As such, a space between the casing and the untreated sides of the wellbore (216) may be cemented to hold the casing in place. The cement may be forced through a lower end of the casing and into an annulus between the casing and a wall of the wellbore (216). More specifically, a cementing plug may be used for pushing the cement from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

As further shown in FIG. 2, sensors (221) may be included in a sensor assembly (223), which is positioned adjacent to a drill bit (224) and coupled to the drill string (215). Sensors (221) may also be coupled to a processor assembly that includes a processor, memory, and an analog-to-digital converter (222) for processing sensor measurements. For example, the sensors (221) may include acoustic sensors, such as accelerometers, measurement microphones, contact microphones, and hydrophones. Likewise, the sensors (221) may include other types of sensors, such as transmitters and receivers to measure resistivity, gamma ray detectors, etc. The sensors (221) may include hardware and/or software for generating different types of well logs (such as acoustic logs or density logs) that may provide well data about a wellbore, including porosity of wellbore sections, gas saturation, bed boundaries in a geologic formation, fractures in the wellbore or completion cement, and many other pieces of information about a formation. If such well data is acquired during drilling operations (i.e., logging-while-drilling), then the information may be used to make adjustments to drilling operations in real-time. Such adjustments may include rate of penetration (ROP), drilling direction, altering mud weight, and many others drilling parameters.

In some embodiments, acoustic sensors may be installed in a drilling fluid circulation system of a drilling system (200) to record acoustic drilling signals in real-time. Drilling acoustic signals may transmit through the drilling fluid to be recorded by the acoustic sensors located in the drilling fluid circulation system. The recorded drilling acoustic signals may be processed and analyzed to determine well data, such as lithological and petrophysical properties of the rock formation. This well data may be used in various applications, such as steering a drill bit using geosteering, casing shoe positioning, etc.

The control system (244) may be coupled to the sensor assembly (223) in order to perform various program functions for up-down steering and left-right steering of the drill bit (224) through the wellbore (216). More specifically, the control system (244) may include hardware and/or software with functionality for geosteering a drill bit through a formation in a lateral well using sensor signals, such as drilling acoustic signals or resistivity measurements. For example, the formation may be a reservoir region, such as a pay zone, bed rock, or cap rock.

Turning to geosteering, geosteering may be used to position the drill bit (224) or drill string (215) relative to a boundary between different subsurface layers (e.g., overlying, underlying, and lateral layers of a pay zone) during drilling operations. In particular, measuring rock properties during drilling may provide the drilling system (200) with the ability to steer the drill bit (224) in the direction of desired hydrocarbon concentrations. As such, a geosteering system may use various sensors located inside or adjacent to the drill string (215) to determine different rock formations within a well path. In some geosteering systems, drilling tools may use resistivity or acoustic measurements to guide the drill bit (224) during horizontal or lateral drilling.

Returning to FIG. 1, a user device (e.g., user device Y (190) may provide a graphical user interface (e.g., graphical user interface Y (191)) for communicating with an automated drilling manager, e.g., to monitor drilling operations, drilling fluid operations, and drilling cost data (e.g., drilling cost data A (111)). For example, a user device may be a personal computer, a human-machine interface, a smartphone, or another type of computer device for presenting information and obtaining user inputs in regard to the presented information. Likewise, the user device may obtain various user selections (e.g., user selections Y (192)) in regard to drilling operations, such as based on real-time changes to drilling costs for a wellbore. Likewise, the user device may display various reports that may include charts as well as other arrangements of well data (e.g., drilling operation reports Y (193) includes cost-per-foot values Y (194)).

In some embodiments, an automated drilling manager includes hardware and/or software with functionality for generating and/or updating one or more machine-learning models to determine drilling cost data. For example, a drilling cost model may correspond to one or more types of machine-learning models that are trained to predict drilling cost data. Examples of machine-learning models may include artificial neural networks, such as convolutional neural networks, deep neural networks, and recurrent neural networks. Machine-learning models may also include support vector machines, decision trees, inductive learning models, deductive learning models, supervised learning models, unsupervised learning models, reinforcement learning models, etc. In a deep neural network, for example, a layer of neurons may be trained on a predetermined list of features based on the previous network layer's output. Thus, as data progresses through the deep neural network, more complex features may be identified within the data by neurons in later layers. Likewise, a U-net model or other type of convolutional neural network model may include various convolutional layers, pooling layers, fully connected layers, and/or normalization layers to produce a particular type of output. Thus, convolution and pooling functions may be the activation functions within a convolutional neural network.

In some embodiments, two or more different types of machine-learning models are integrated into a single machine-learning architecture, e.g., a machine-learning model may include support vector machines and neural networks. In some embodiments, an automated drilling manager may generate augmented data or synthetic data to produce a large amount of interpreted data for training a particular model. Likewise, an automated drilling manager may obtain a variety of cost data and physical well site data for validating a drilling cost model.

In some embodiments, various types of machine learning algorithms may be used to train the model, such as a backpropagation algorithm. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the machine-learning model.

With respect to artificial neural networks, for example, an artificial neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights for adjusting the data inputs. These network weights may amplify or reduce the value of a particular data input, thereby assigning an amount of significance to various data inputs for a task being modeled. Through machine learning, a neural network may determine which data inputs should receive greater priority in determining one or more specified outputs of the artificial neural network. Likewise, these weighted data inputs may be summed such that this sum is communicated through a neuron's activation function to other hidden layers within the artificial neural network. As such, the activation function may determine whether and to what extent an output of a neuron progresses to other neurons where the output may be weighted again for use as an input to the next hidden layer.

Turning to recurrent neural networks, a recurrent neural network (RNN) may perform a particular task repeatedly for multiple data elements in an input sequence (e.g., a sequence of temperature values from an inlet to an outlet), with the output of the recurrent neural network being dependent on past computations. As such, a recurrent neural network may operate with a memory or hidden cell state, which provides information for use by the current cell computation with respect to the current data input. For example, a recurrent neural network may resemble a chain-like structure of RNN cells, where different types of recurrent neural networks may have different types of repeating RNN cells. Likewise, the input sequence may be time-series data, where hidden cell states may have different values at different time steps during a prediction or training operation. For example, where a deep neural network may use different parameters at each hidden layer, a recurrent neural network may have common parameters in an RNN cell, which may be performed across multiple time steps. To train a recurrent neural network, a supervised learning algorithm such as a backpropagation algorithm may also be used. In some embodiments, the backpropagation algorithm is a backpropagation through time (BPTT) algorithm. Likewise, a BPTT algorithm may determine gradients to update various hidden layers and neurons within a recurrent neural network in a similar manner as used to train various deep neural networks. In some embodiments, a recurrent neural network is trained using a reinforcement learning algorithm such as a deep reinforcement learning algorithm. For more information on reinforcement learning algorithms, see the discussion below.

Embodiments are contemplated with different types of RNNs. For example, classic RNNs, long short-term memory (LSTM) networks, a gated recurrent unit (GRU), a stacked LSTM that includes multiple hidden LSTM layers (i.e., each LSTM layer includes multiple RNN cells), recurrent neural networks with attention (i.e., the machine-learning model may focus attention on specific elements in an input sequence), bidirectional recurrent neural networks (e.g., a machine-learning model that may be trained in both time directions simultaneously, with separate hidden layers, such as forward layers and backward layers), as well as multidimensional LSTM networks, graph recurrent neural networks, grid recurrent neural networks, etc. With regard to LSTM networks, an LSTM cell may include various output lines that carry vectors of information, e.g., from the output of one LSTM cell to the input of another LSTM cell. Thus, an LSTM cell may include multiple hidden layers as well as various pointwise operation units that perform computations such as vector addition.

In some embodiments, an automated drilling manager uses one or more ensemble learning methods in connection to one or more drilling cost models. For example, an ensemble learning method may use multiple types of machine-learning models to obtain better predictive performance than available with a single machine-learning model. In some embodiments, for example, an ensemble architecture may combine multiple base models to produce a single machine-learning model. One example of an ensemble learning method is a BAGGing model (i.e., BAGGing refers to a model that performs Bootstrapping and Aggregation operations) that combines predictions from multiple neural networks to add a bias that reduces variance of a single trained neural network model. Another ensemble learning method includes a stacking method, which may involve fitting many different model types on the same data and using another machine-learning model to combine various predictions.

While FIGS. 1 and 2 shows various configurations of components, other configurations may be used without departing from the scope of the disclosure. For example, various components in FIGS. 1 and 2 may be combined to create a single component. As another example, the functionality performed by a single component may be performed by two or more components.

Figure 3:
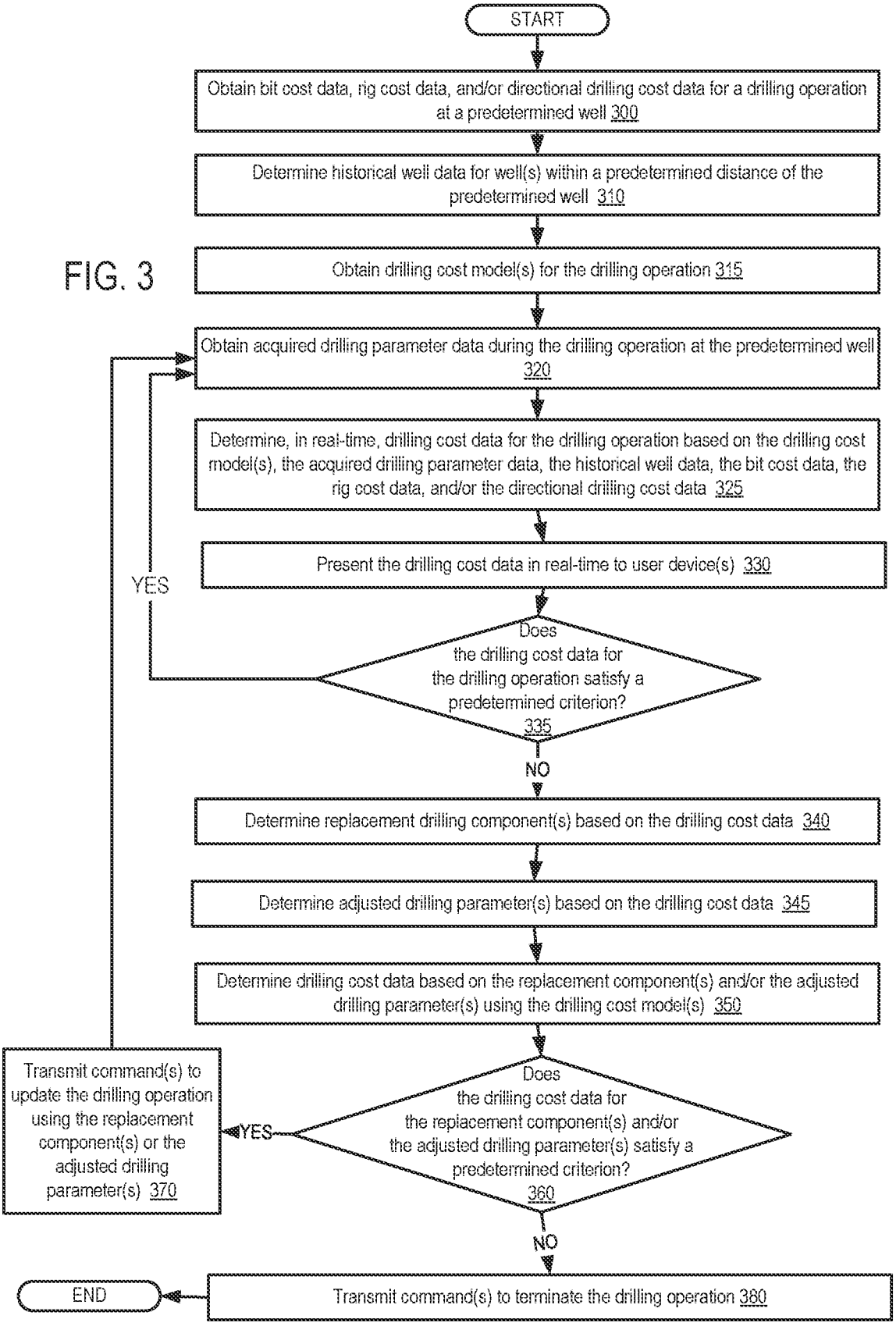
FIG. 3 shows a flowchart in accordance with one or more embodiments.

Turning to FIG. 3, FIG. 3 shows a flowchart in accordance with one or more embodiments. Specifically, FIG. 3 describes a general method for managing a drilling operation based on drilling cost data. One or more blocks in FIG. 3 may be performed by one or more components (e.g., automated drilling manager (110)) as described in FIGS. 1 and 2. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 300, bit cost data, rig cost data, and/or directional drilling cost data are obtained for a drilling operation at a predetermined well in accordance with one or more embodiments. For example, different metrics may contribute to a final cost of a drilling operation, such as the cost of a particular drill bit, cost of drilling fluid and any lost circulation materials, and the amount of time required to use a drilling rig, rig personnel, and well equipment.

In Block 310, historical well data are obtained for one or more wells within a predetermined distance of a predetermined well in accordance with one or more embodiments. For example, historical well data may identify geological data relating to one or more wells, such as the type of formation or reservoir. Historical well data may also include drilling cost data relating to the drilling operation for the historical well, as well as the drilling parameters associated with drilling the historical well. Using historical well data for multiple wells, an automated drilling manager may match or correlate historical well data to predict data at a new well. In particular, an automated drilling manager or a user may determine a distance range to determine which historical wells to analyze with respect to the new well. For example, an automated drilling manager may obtain a user selection of the predetermined distance being 500 miles from the new well.

In some embodiments, an automated drilling manager searches a database to determine benchmarks of the current drilling costs with what drilling costs were achieved historically. As such, an automated drilling manager may use various filters to sort and analyze different historical wells. Example filters include location of the historical wells (e.g., is a potential historical well within a distance of 200 km from a well of interest) and the type of formations drilled in a historical well in comparison to formations in the well of interest. Thus, for a given run, drilling costs may be calibrated using historical well data in order to predict drilling costs for the current well.

In Block 315, one or more drilling cost models are obtained for a drilling operation in accordance with one or more embodiments. In some embodiments, for example, a drilling cost model uses historical well data from wells with similar geological and/or drilling parameters in order to predict drilling cost data. For example, a drilling cost model may determine in real-time the cost-per-foot of drilling a particular well. Example input parameters for a drilling cost model may include types of drilling systems (such as drilling systems with similar motors), rig cost, a type of well (e.g., onshore vs offshore well, vertical well or a directional drilling well), bit type (e.g., based on an International Association of Drilling Contractors (IADC) code for a particular bit), wellbore size, and whether the wellbore is new drilling or a re-entry drilling. In some embodiments, historical well data is also input to a drilling cost model.

In some embodiments, a drilling cost model is a machine-learning model. For example, a drilling cost model may be a deep neural network that is trained using a supervised machine-learning algorithm and well data for multiple historical wells. Thus, using geological data and drilling data, the drilling cost model may determine predicted drilling cost data.

In Block 320, acquired drilling parameter data are obtained during a drilling operation at a predetermined well in accordance with one or more embodiments. For example, acquired drilling parameter data may include drilling fluid properties relating to drilling fluid, drilling properties, such as weight-on-bit data, torque data, and rate of penetration (ROP) data, pump pressure data, and well path parameters (such as the current drilling direction). Likewise, acquired drilling parameter data may also include well log data, e.g., to identify the type of formation being drilled in a particular well path.

In some embodiments, drilling parameter data is obtained using a wellsite data protocol, such as a protocol based on a Wellsite Information Transfer Specification (WITS) or a Well-site Information Transfer Standard Markup Language (WITSML). For example, a wellsite data protocol may be a network communication format used within the oil and gas drilling industry for the transfer of well site data from one computer system to another computer system. Thus, one or more drilling systems may transmit drilling parameter data to an automated drilling manager using one or more wellsite data protocols. Likewise, a wellsite data protocol may be used to transmit drilling parameter data offsite from a well network, such as to communicate data to a producing oil company operating the drilling rig.

In Block 325, drilling cost data are obtained in real-time for a drilling operation based on one or more drilling cost models, acquired drilling parameter data, historical well data, bit cost data, rig cost data, and/or directional drilling cost data in accordance with one or more embodiments. For example, drilling cost data may describe the overall predicted cost of a drilling operation, changes to the cost of a drilling operation (e.g., has the cost-per-foot amount decreased or increased since drilling began), and/or individual costs within a drilling operation (e.g., drilling fluid costs are increasing due to hole cleaning efficiency).

In some embodiments, for example, drilling cost data includes a cost-per-foot of drilling a well. In particular, the drilling cost data may be determined, evaluated, and/or compared with historical performances of various historical wells in real-time within a drilling operation. By having access to drilling cost data, a user may assess drilling costs during drilling, such as to quantify based on the drilling costs if the drillers should decide to pull out of a wellbore at a given time (e.g., if drilling costs dramatically exceed original modeled costs for drilling a well).

In some embodiments, drilling cost data include a pull-out-of-hole (POOH) cost data based on the speed removing a bottomhole assembly for a specific drilling rig. Thus, drilling cost data may describe drilling costs associated with different decisions, such as using the current drill bit, replacing any components in a bottomhole assembly, or terminating a drilling operation altogether. Likewise, drilling cost data may describe multiple scenarios of different combinations of components (e.g., multiple different drill bits may be used in a single drilling operation), where a user device may select the most cost-effective combination for the remaining portion of a drilling operation.

Figure 4:
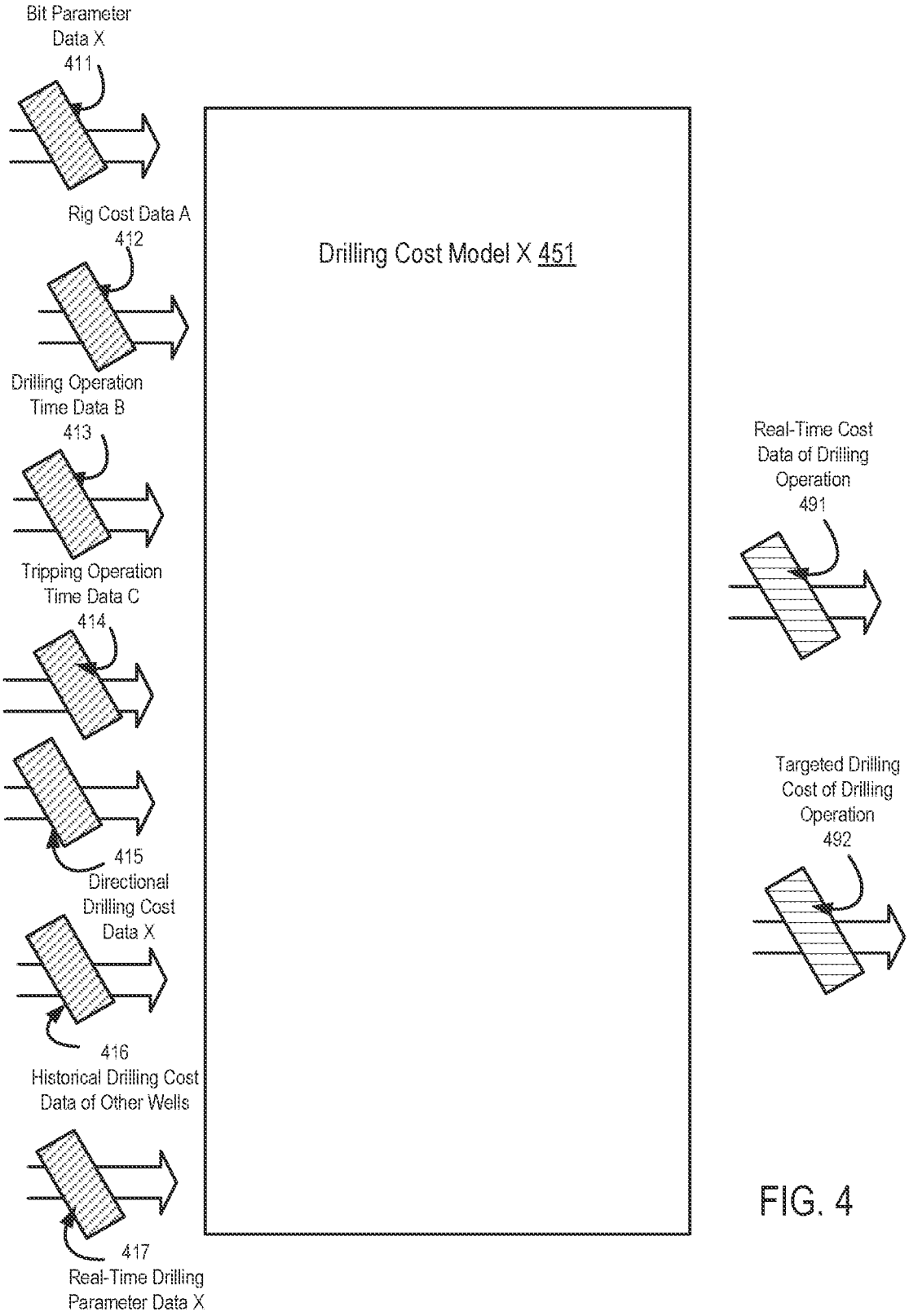
FIGS. 4, 5A, 5B, 5C, 6A, 6B, and 6C shows examples in accordance with one or more embodiments.

Turning to FIG. 4, FIG. 4 provides an example of a drilling cost model in accordance with one or more embodiments. In FIG. 4, a drilling cost model X (451) determines real-time cost data (491) of a drilling operation and a predetermined criterion, i.e., targeted drilling cost (492) of a drilling operation. More specifically, the drilling cost model X (451) obtains the following inputs, i.e., bit parameter data X (411), rig cost data A (412), drilling operation time data B (413), tripping operation time data C (414), directional drilling cost data X (415), historical drilling cost data (416) of other wells, and real-time drilling parameter data X (417). The targeted drilling cost (492) may be based on the historical drilling cost data (416) and other historical well data (not shown). Based on the input data, the drilling cost model X (451) determines real-time cost data (491) for proceeding with the current drilling operation. Real-time cost data (491) may be measured in a cost-per-foot of proceeding with a drilling operation, for example. This real-time cost data (491) may also be compared with various predicted costs of replacing one or more components (such as a drill bit) in the drilling operation at that moment as well as future predicted costs for completing the drilling operation with the current setup.

Returning to FIG. 3, in Block 330, drilling cost data is presented in real-time to one or more user devices in accordance with one or more embodiments. In some embodiments, drilling cost data may be monitored using one or more user devices. For example, drilling cost data may be presented on a display device using a cost-per-length curve (e.g., a cost-per-foot or cost-per-meter curve) in real-time. Along with plotting of drilling cost data versus time, an automated drilling manager may also plot a drilling cost curve versus depth (e.g., true vertical depth), an initially targeted drilling cost value (e.g., a desired cost-per-length value), and a comparison with a current drilling cost values or historical performance values. Thus, drilling cost data may be quantified based on performance percentiles (e.g., 90 percentile, 75 percentile, 60 percentile, etc.). Moreover, drilling cost data may be presented with qualitative analysis, such as whether drilling costs are increasing or decreasing. Likewise, an automated drilling manager may transmit one or more alert notifications to various user devices if a drilling cost exceeds one or predetermined thresholds (e.g., drilling costs are higher than historical data predicted).

In some embodiments, a section of a well path or drilling run is identified in presented data that has the lowest achieved drilling cost (i.e., was the most cost-efficient). Thus, real-time drilling cost data may be compared with estimated drilling cost data if a bottomhole assembly is removed from a wellbore in a POOH operation based on a targeted drilling cost. At the beginning of a drilling run, for example, a drilling operation may stop in order to change to a more cost-efficient combination of components based on geological and drilling conditions.

Figure 5A:
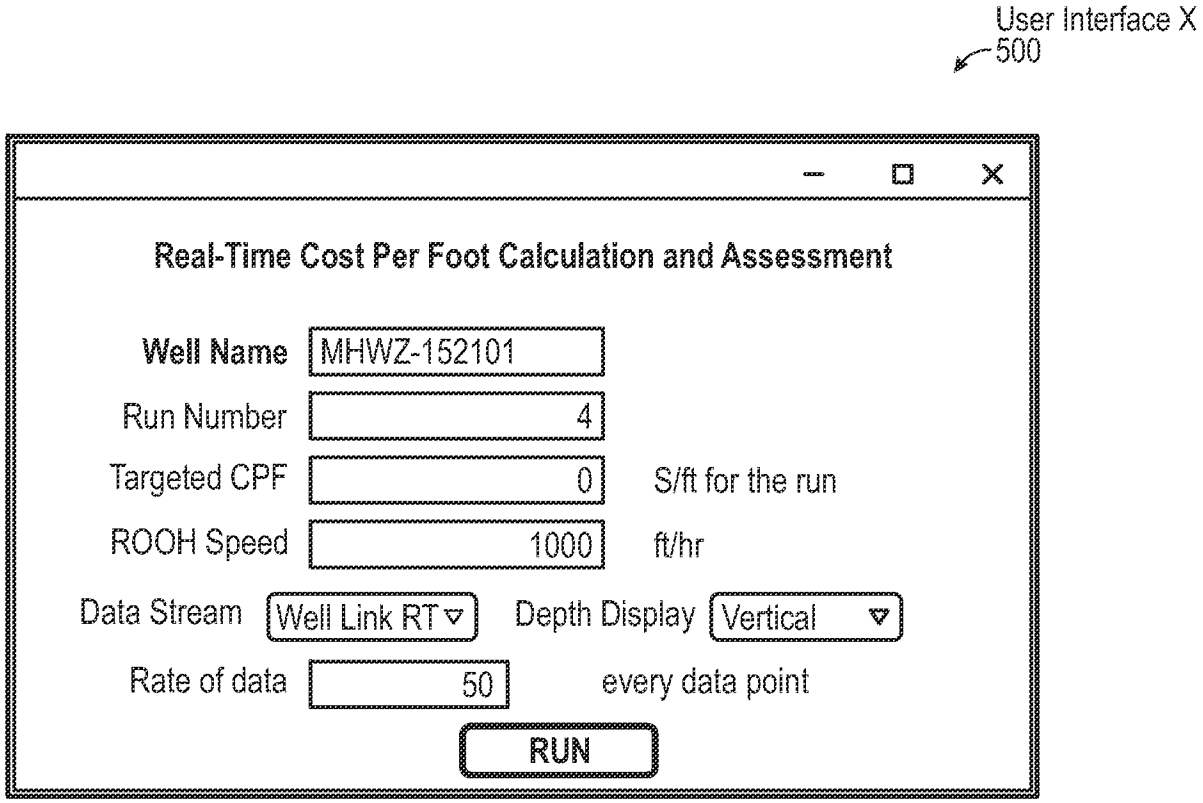
Figure 5B:
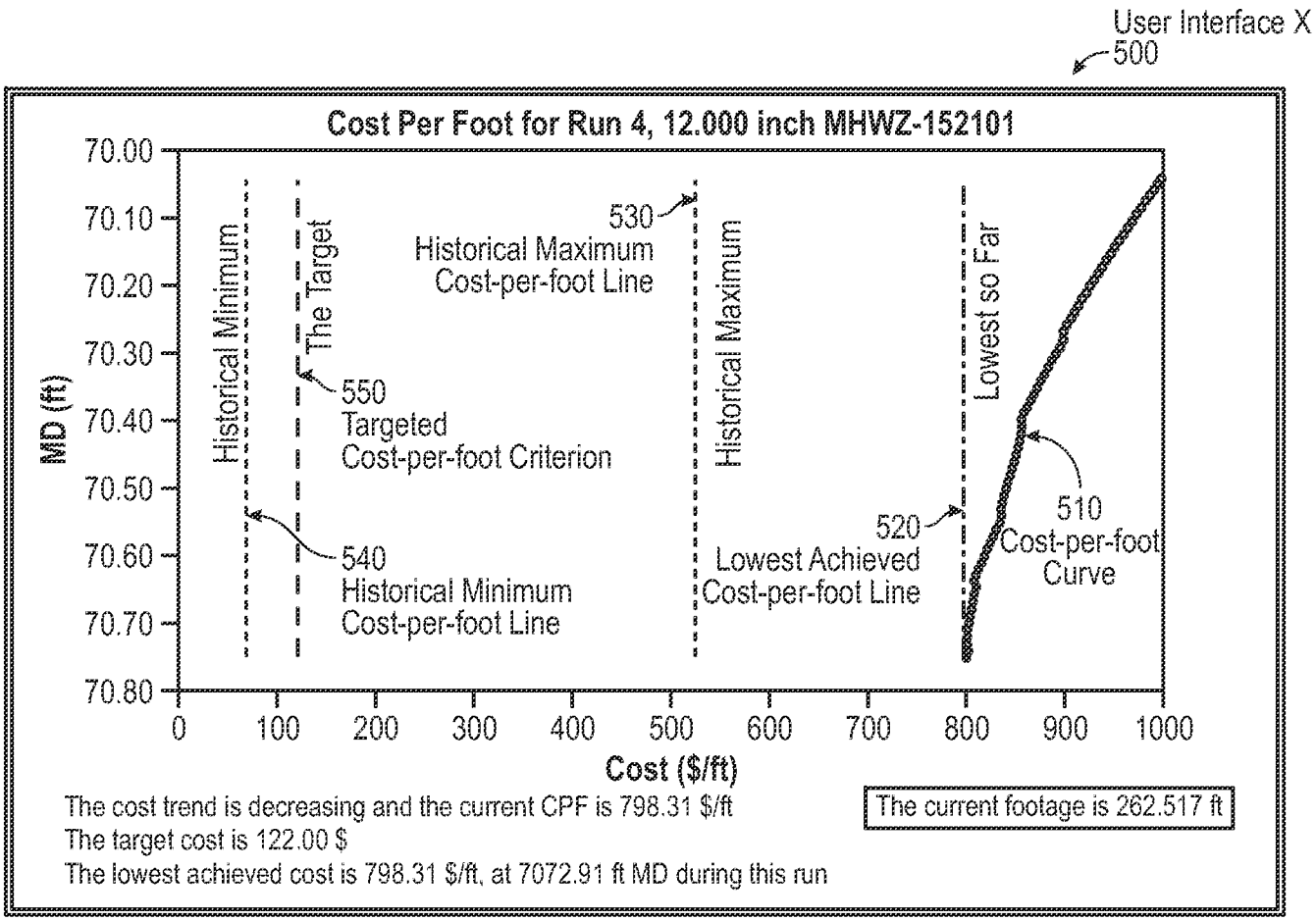
Figure 5C:
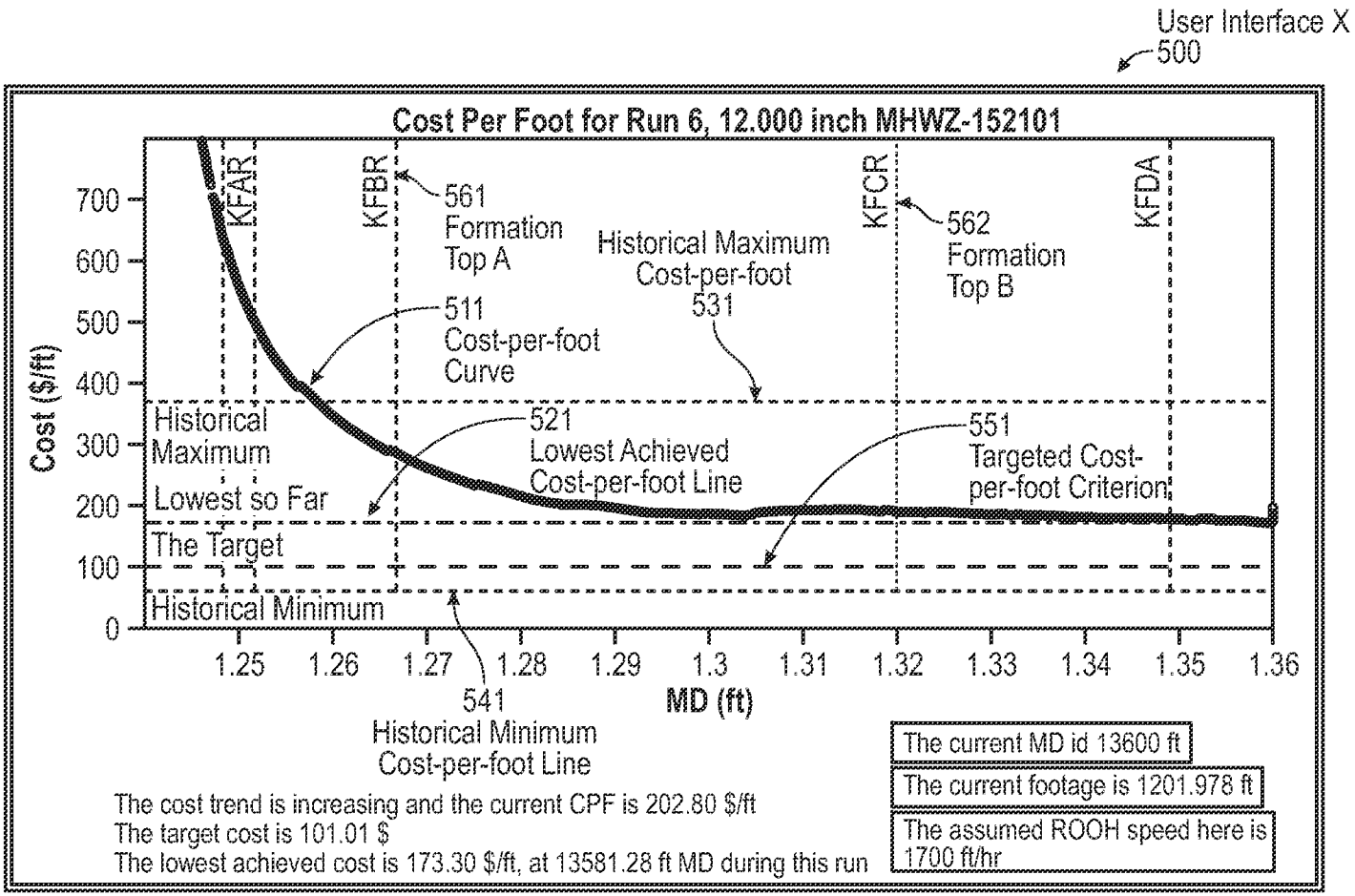

Turning to FIGS. 5A-5C, FIGS. 5A-5C shows various examples of user interfaces for presenting drilling cost data and/or managing a drilling operation with drilling cost data in accordance with one or more embodiments. In FIG. 5A, a user interface X (500) is shown with several input fields for determining drilling cost data. In particular, user interface X (500) include the following input fields: (a) an input field for a well name as listed in a database (i.e., "well name"); (b) an input field for a drilling run number which may change every time a pull-out-of-hole (POOH) operation is performed with a bottomhole assembly; (c) an input field for a targeted criterion for a cost-per-foot threshold or other cost-per-length threshold for a particular drilling run as set by a user or automatically be an automated drilling manager (e.g., a 10 percentile value); (d) an input field for an assumed POOH Speed with a default value of 1000 ft/hr; (e) an input field for a data stream protocol; and (f) an input field for a depth display, such as a vertical or horizontal display; and (g) an input field for a display frequency of real-time data for a drilling operation. Thus, a user may provide inputs to various fields in the user interface X (500). Likewise, input fields may be automatically selected by one or more control systems or an automated drilling manager.

Turning to FIG. 5B, the user interface X (500) presents a vertical display where a current cost-per-foot curve (510) is plotted in real time as new drilling operation data is obtained (e.g., drilling operation time, hole depth, bit depth). A lowest achieved cost-per-foot line (520) is shown for the current drilling operation. Likewise, a historical minimum cost-per-foot line (540) and a historical maximum cost-per-foot line (530) are presented based on historical well data. A targeted cost-per-foot criterion (550) is also shown for a particular drilling run as set by a user or based on the historical well data.

In FIG. 5C, the user interface X (500) presents a horizontal display with a current cost-per-foot curve (511) that is plotted in real time, as new drilling parameter data is obtained. Likewise, a lowest achieved cost-per-foot line (521) is shown for the current drilling operation along with a targeted cost-per-foot criterion (551) and a historical minimum cost-per-foot line (541) and a historical maximum cost-per-foot line (531) based on historical well data. Additionally, various formation tops (e.g., formation top A (561), formation top B (562)) are displayed as vertical dashed lines and annotated accordingly. In particular, different geological formations may have different drilling costs associated with them, where the historical minimum and historical maximum values may be functions of geological formation types. Thus, rather than a straight line, the historical maximum and historical minimum may be curves or stepped lines.

Returning to FIG. 3, in Block 335, a determination is made whether drilling cost data for a drilling operation satisfies a predetermined criterion in accordance with one or more embodiments. For example, the predetermined criterion may be a targeted drilling cost for an entire drilling operation or a particular section of a well path. Likewise, predetermined criteria may be user-defined based on a user selection in a user interface or automatically determined by an automated drilling manager based on historical well data. For example, an automated drilling manager may determine a predetermined criterion based on a predetermined margin with drilling costs for similar drilling operations through similar geological formations. If it is determined that the drilling cost data satisfies the predetermined criterion, the process may return to Block 320. If a determination is made that the drilling cost data fails to satisfy the predetermined criterion, the process may proceed to Block 340.

In Block 340, one or more replacement drilling components are determined based on drilling cost data in accordance with one or more embodiments. In some embodiments, for example, a drill bit is replaced based on the current cost-per-foot of the drilling operation. For example, a drill bit may be worn down, such that a replacement drill bit may improve performance of the drilling operation such that the overall drilling costs associated with the replacement are outweighed by the improvement to drilling performance. Likewise, other components of a drilling string or a drilling operation may also be replaced. For example, a bottomhole assembly may be removed in order to fit a different type of drill string or drill bit. Selecting a suitable replacement bit may be based on various geological factors, such as pore pressure, rock hardness, and abrasiveness. Thus, a replacement drill bit may improve drilling costs by increasing drilling efficiency. Likewise, changes may be made to the type of drilling fluid being used in the wellbore for a given geological formation currently being drilled.

In Block 345, one or more adjusted drilling parameters are determined based on drilling cost data in accordance with one or more embodiments. For example, if certain drilling parameters are increasing drilling costs, drilling parameters may be adjusted (e.g., based on drilling parameters for other historical wells) to increase performance and thereby reduce drilling costs.

In Block 350, drilling cost data are determined using one or more drilling cost models and based on one or more replacement drilling components and/or one or more adjusted drilling parameters in accordance with one or more embodiments. Depending on which alternatives are available for a particular drilling operation, drilling cost data may be determined for different replacement components, such as different drill bits, and/or different drilling parameters. For example, an automated drilling manager may analyze alternative drill bits based on historical well data to determine which replacement bit may reduce the drilling costs in order to satisfy a predetermined criterion.

In Block 360, a determination is made whether drilling cost data for one or more replacement components and/or one or more adjusted drilling parameters satisfies a predetermined criterion in accordance with one or more embodiments. Based on the drilling costs associated with different replacement components and/or different drilling parameters, an automated manager may decide to proceed with the current drilling setup, initiate a pull-out-of-hole operation to modify the bottomhole assembly, or terminate the drilling operation altogether. For example, if there is a minimum drilling cost for a well to be profitable, a user or an automated drilling manager may terminate the drilling operation.

Furthermore, the predetermined criterion may be the same or a different predetermined criterion as described above in Block 335. If a determination is made that one or more replacement components and/or one or more adjusted drilling parameters satisfy a predetermined criterion, the process may proceed to Block 370. If a determination is made that no replacement components or adjusted drilling parameters may satisfy the predetermined criterion, the process may proceed to Block 380.

In Block 370, one or more commands are transmitted to update a drilling operation using one or more replacement components or one or more adjusted drilling parameters in accordance with one or more embodiments. For example, commands may be transmitted to various control system to automate a pull-out-of-hole operation, stop drilling, or perform other operations necessary for changing components or drilling parameters. Likewise, a user or an automated drilling manager may select different replacement components or adjusted drilling parameters to achieve different drilling cost values. A user selection may be obtained within a graphical user interface and be part of the request from a user device to replace a drill bit.

In Block 380, one or more commands are transmitted to terminate a drilling operation in accordance with one or more embodiments.

Figure 6A:
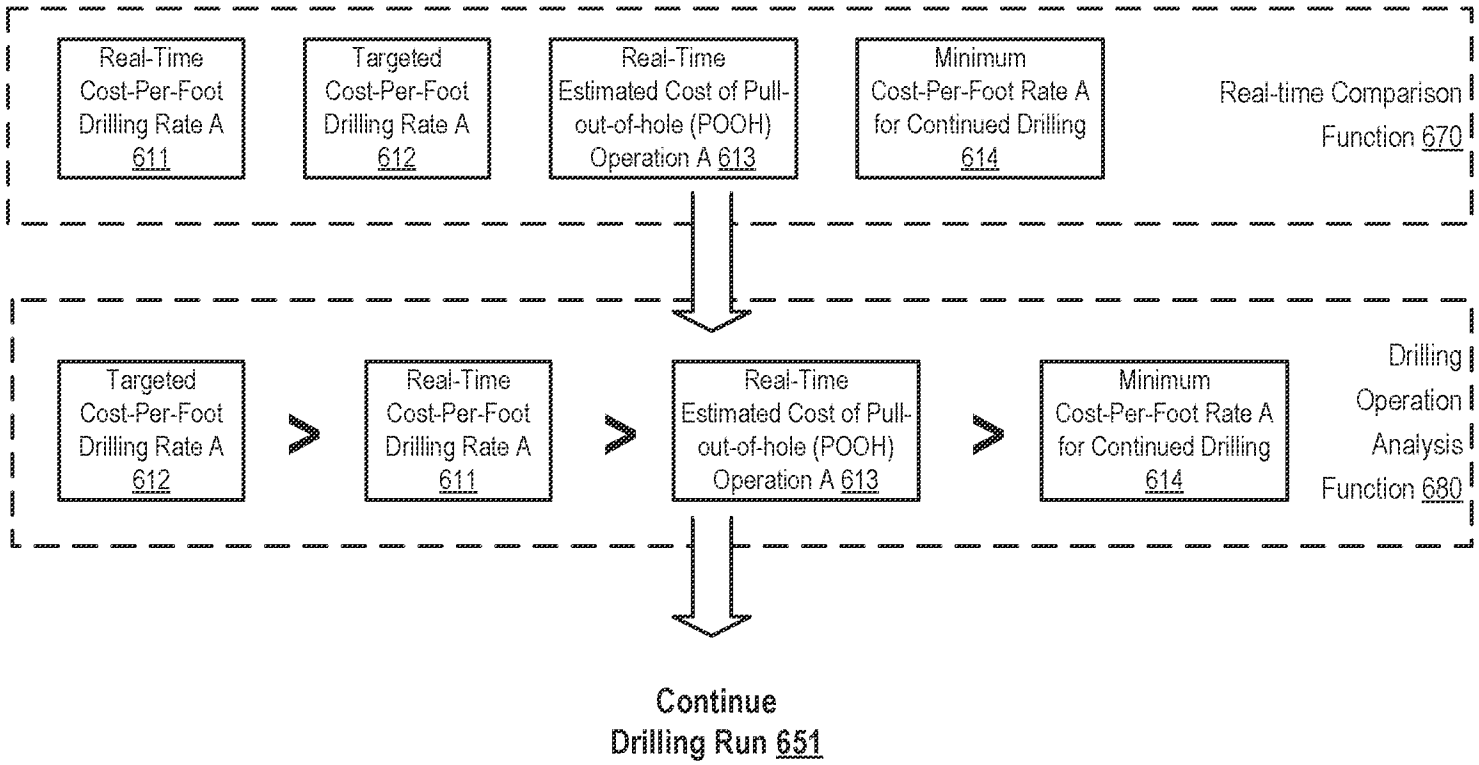
Figure 6B:
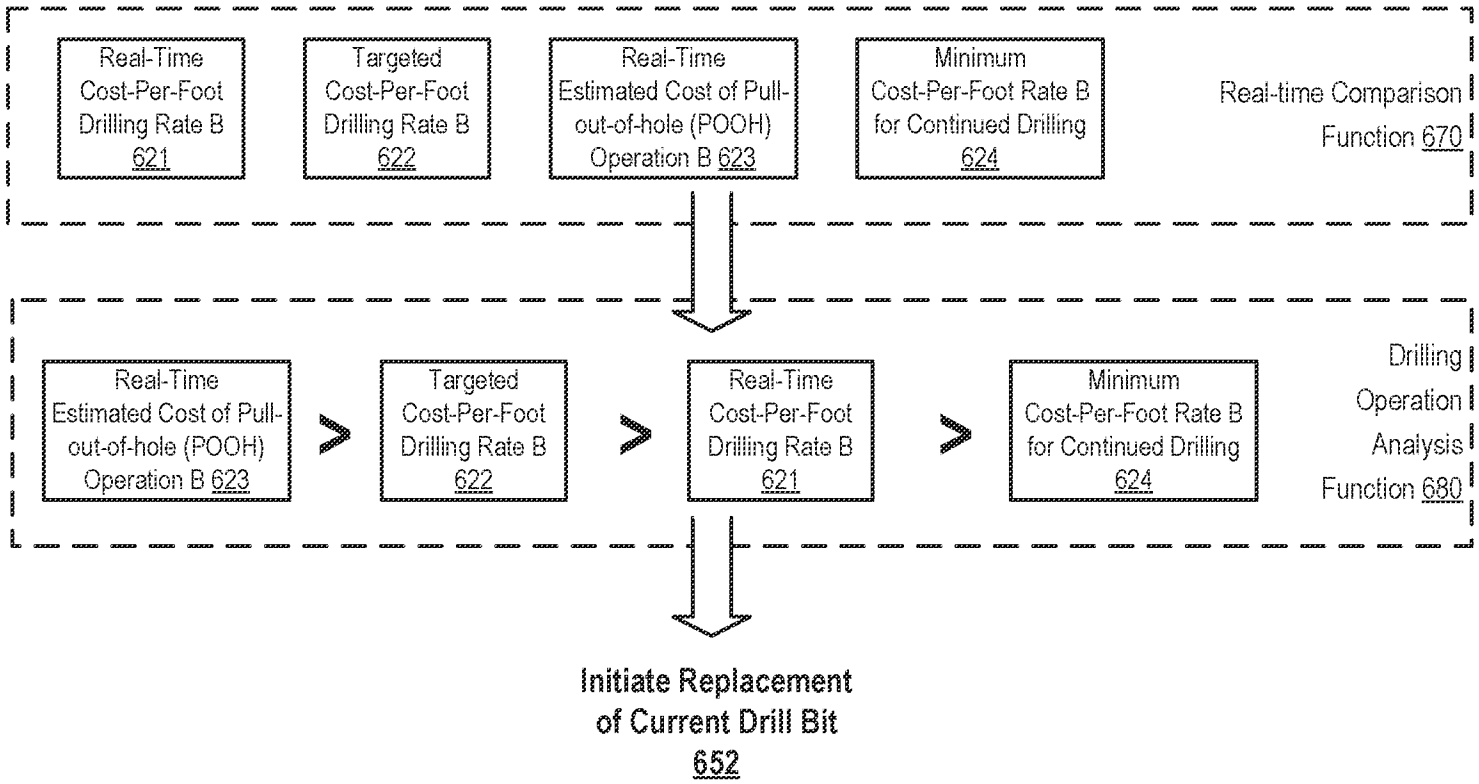
Figure 6C:
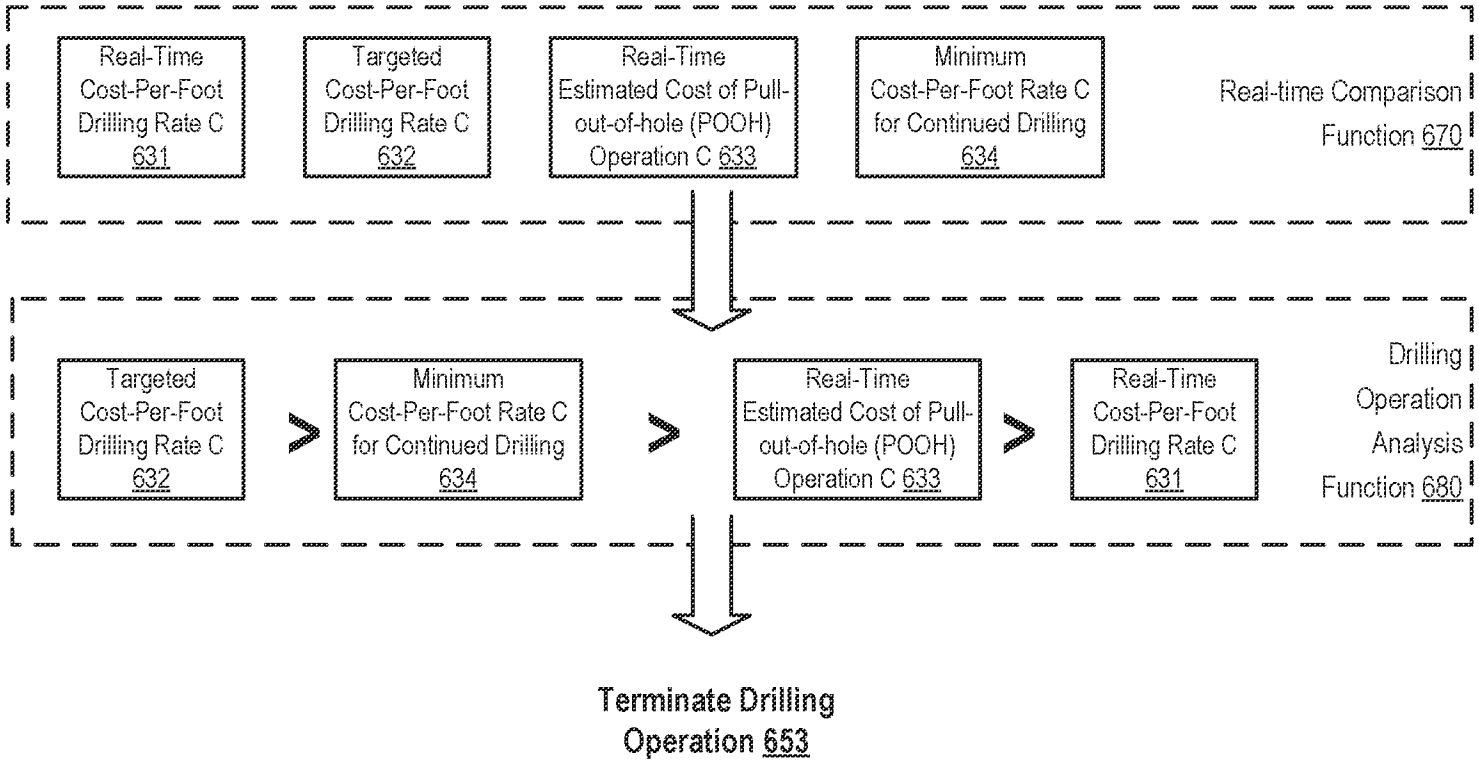

Turning to FIGS. 6A, 6B, and 6C, FIGS. 6A, 6B, and 6C illustrate examples of automatically determining drilling operations based on real-time drilling cost data in accordance with one or more embodiments. The following examples are for explanatory purposes only and not intended to limit the scope of the disclosed technology. In FIG. 6A, an automated drilling manager (not shown) determines various drilling cost data in real-time during a drilling operation, such as real-time cost-per-foot (CPF) drilling rate A (611) and a real-time estimated cost of a pull-out-of-hole (POOH) operation A (613). For example, the real-time CPF drilling rate A (611) may be based on rate-of-penetration data, while the real-time estimated cost of a POOH operation A (613) may be based on the current depth of a drill string. Likewise, the automated drilling manager also obtains as inputs two predetermined criteria, i.e., a targeted CPF drilling rate A (612) and a minimum CPF rate A (614) for continued drilling. For example, the targeted CFP drilling rate A (612) and the minimum CPF rate A (614) may be based on historical well data and geological data for the underlying formation. The targeted CFP drilling A (612) for an efficient drilling operation given the particular formations that are being traversed, which may change for different sections of a well path. Likewise, the minimum CPF rate A (614) corresponds to a minimum CPF rate A (614) necessary for continued drilling. For example, if the geological surveys predicting the underlying formations are significantly different from the actual geological formations, the current drilling operation may require termination, such as due to the drilling of the well be uneconomical. Based on a current real-time CPF drilling rate being below the minimum CPF rate A (614) for an extended period of time, a driller may need to return to the planning stages to select a different well or different drilling operation.

Keeping with FIG. 6A, an automated drilling manager applies a real-time comparison function (670) to the input data, i.e., real-time CPF drilling rate A (611), targeted CPF drilling rate A (612), real-time estimated cost of POOH operation A (613), and minimum CPF rate A (614). The resulting output of the real-time comparison function (670) shows that the real-time CPF drilling rate A (611) is worse than the targeted CPF drilling rate A (612) (i.e., the actual costs are greater than the targeted costs according to the targeted CPF drilling rate A (612), but above the real-time estimated cost of a POOH operation A (613) and the minimum CPF rate A (614). Therefore, the automated drilling manager uses the resulting output with a drilling operation analysis function (680) to determine to an operation (651) to continue the drilling run.

In FIG. 6B, the automated drilling manager determines various drilling cost data in real-time during another drilling operation, such as real-time CFP drilling rate B (621) and a real-time estimated cost of a POOH operation B (623)). The automated drilling manager also obtains two predetermined criteria, i.e., a targeted CPF drilling rate B (622) and a minimum CPF rate B (624) for continued drilling. Using the real-time comparison function (670), the automated drilling manager determines that the real-time estimated cost of the POOH operation B (623) is better than the current real-time CPF drilling rate B (621). The automated drilling manager also determines that the real-time estimated cost (623) would be better than the targeted CPF drilling rate B (622) and the minimum CPF rate B (624) (i.e., the real-time estimate cost (623) would have lower costs than the targeted CPF drilling rate B (622) and the minimum CPF rate B (624)). Based on the drilling operation analysis function (680), the automated drilling manager causes an operation (652) that initiates replacement of the current drill bit.

In FIG. 6C, the automated drilling manager determines various drilling cost data in real-time during another drilling operation, such as real-time CFP drilling rate C (631) and a real-time estimated cost of a POOH operation C (633)). The automated drilling manager also obtains two predetermined criteria, i.e., a targeted CPF drilling rate C (632) and a minimum CPF rate C (634) for continued drilling. Using the real-time comparison function (670), the automated drilling manager determines that the real-time estimated cost of the POOH operation C (633) is better than the current real-time CPF drilling rate C (631), but also worse than the targeted CPF drilling rate C (634) and the minimum CPF rate C (634). Based on the drilling operation analysis function (680), the automated drilling manager determines that the drilling operation needs to be terminated and causes an operation (653) that terminates the drilling operation.

Figure 7:
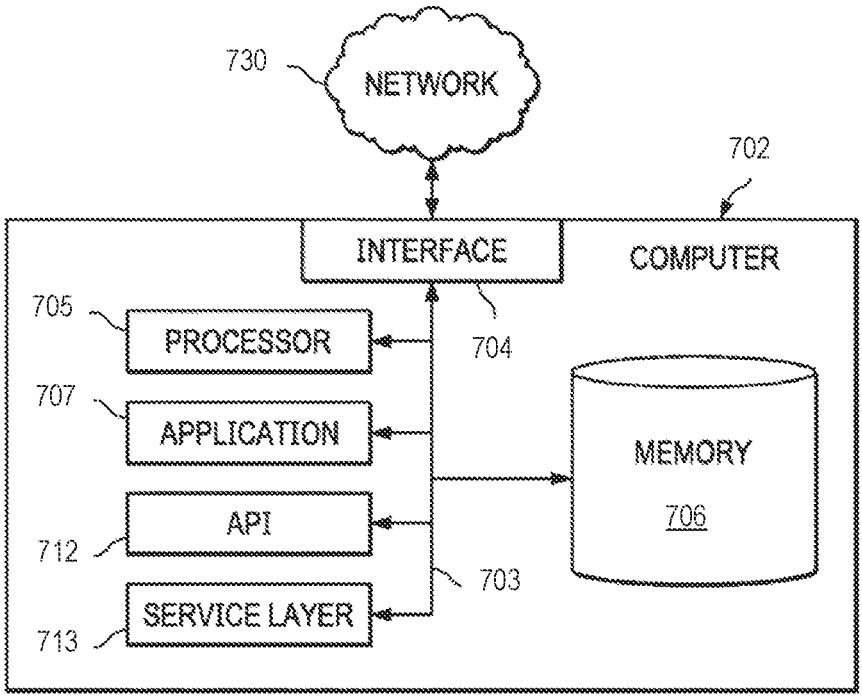
FIG. 7 shows a computer system in accordance with one or more embodiments.

Embodiments may be implemented on a computer system. FIG. 7 is a block diagram of a computer system (702) used to provide computational functionalities associated with described algorithms, methods, functions, processes, flows, and procedures as described in the instant disclosure, according to an implementation. The illustrated computer (702) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730) or cloud. In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) or cloud from a client application (for example, executing on another computer (702)) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or other suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 7, two or more interfaces (704) may be used according to particular needs, desires, or particular implementations of the computer (702). The interface (704) is used by the computer (702) for communicating with other systems in a distributed environment that are connected to the network (730). Generally, the interface (704 includes logic encoded in software or hardware (or a combination of software and hardware) and operable to communicate with the network (730) or cloud. More specifically, the interface (704) may include software supporting one or more communication protocols associated with communications such that the network (730) or interface's hardware is operable to communicate physical signals within and outside of the illustrated computer (702).

The computer (702) includes at least one computer processor (705).

Although illustrated as a single computer processor (705) in FIG. 7, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 7, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), each computer (702) communicating over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

In some embodiments, the computer (702) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), artificial intelligence as a service (AIaaS), serverless computing, and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining, by an automated drilling manager comprising a computer processor, first acquired drilling parameter data regarding one or more drilling parameters in real-time during a drilling operation for a predetermined well, wherein the drilling operation is performed using a first drilling fluid;

obtaining, by the automated drilling manager, geological data for one or more formations in the predetermined well;

determining, by the automated drilling manager and based on a drilling cost model, first drilling cost data using the first acquired drilling parameter data and the geological data, wherein the first drilling cost data comprises a real-time cost of drilling the predetermined well at a current drilling rate in the drilling operation;

determining, by the automated drilling manager computer processer, whether the first drilling cost data satisfies a predetermined criterion;

determining, by the automated drilling manager computer processor and in response determining that the first drilling cost data fails to satisfy the predetermined criterion, a replacement component for the drilling operation;

determining, by the automated drilling manager computer processor and based on the drilling cost model, second drilling cost data based on using the replacement component for the drilling operation;

determining, by the automated drilling manager and based on the drilling cost model, the geological data, and the first acquired drilling parameter data, third drilling cost data for the first drilling fluid being used in the drilling operation and fourth drilling cost data of a replacement drilling fluid for the drilling operation, wherein the replacement drilling fluid is different from the first drilling fluid, wherein the drilling cost model is an artificial neural network comprising an input layer, an output layer, and a plurality of hidden layers, and wherein the geological data and the first acquired drilling parameter data are inputs to the input layer of the artificial neural network;

determining, by the automated drilling manager, whether the third drilling cost data of the first drilling fluid exceeds the fourth drilling cost data of the replacement drilling fluid;

transmitting, by the automated drilling manager and to a first control system, a first command to update the drilling operation by changing a drilling system to use the replacement component in response to determining that the second drilling cost data satisfies the predetermined criterion; and transmitting, by the automated drilling manager and to a second control system coupled to a mud pump system, a second command that automatically changes the first drilling fluid to the replacement drilling fluid in the drilling operation in response to the third drilling cost data exceeding the fourth drilling cost data.

2. The method of claim 1, wherein the first acquired drilling parameter data corresponds to a first drill bit operating at a predetermined rate of penetration (ROP), wherein the replacement component is a second drill bit that is different from the first drill bit, and wherein the second drilling cost data corresponds to the second drill bit operating at the predetermined ROP.

3. The method of claim 1, wherein the predetermined criterion corresponds to a predetermined cost-per-length of a first drilling run in a well path, and wherein the well path is produced by the drilling operation using a plurality of drilling runs comprising the first drilling run.

4. The method of claim 1, further comprising:

determining, based on the drilling cost model, fifth drilling cost data using second acquired drilling parameter data that is obtained in real-time during the drilling operation; and transmitting a third command to terminate the drilling operation in response to determining that the fifth drilling cost data fails to satisfy the predetermined criterion.

5. The method of claim 1, further comprising:

obtaining directional drilling cost data for the drilling operation, wherein the first drilling cost data is determined using the drilling cost model and the directional drilling cost data.

6. The method of claim 1, further comprising:

obtaining rig cost data for a drilling rig that performs the drilling operation, wherein the first drilling cost data is determined using the drilling cost model and the rig cost data.

7. A system, comprising:

a drilling system comprising a plurality of sensors and a drill string comprising a drill bit, wherein the drilling system is coupled to a wellbore;

a mud pump system configured to supply a first drilling fluid to the wellbore;

a control system coupled to the mud pump system; and an automated drilling manager coupled to the drilling system, the mud pump system, and the control system, wherein the automated drilling manager comprises a computer processor, the automated drilling manager being configured to perform a method comprising:

obtaining first acquired drilling parameter data regarding one or more drilling parameters in real-time during a drilling operation for a predetermined well associated with the wellbore, wherein the drilling operation is performed using the first drilling fluid;

obtaining geological data for one or more formations in the predetermined well;

determining, based on a drilling cost model, first drilling cost data using the first acquired drilling parameter data and the geological data, wherein the first drilling cost data comprises a real-time cost of drilling the predetermined well at a current drilling rate in the drilling operation;

determining whether the first drilling cost data satisfies a predetermined criterion;

determining, in response determining that the first drilling cost data fails to satisfy the predetermined criterion, a replacement component for the drilling operation;

determining, based on the drilling cost model, second drilling cost data based on using the replacement component for the drilling operation;

determining, based on the drilling cost model, the geological data, and the first acquired drilling parameter data, third drilling cost data for the first drilling fluid being used in the drilling operation and fourth drilling cost data of a replacement drilling fluid for the drilling operation, wherein the replacement drilling fluid is different from the first drilling fluid, wherein the drilling cost model is an artificial neural network comprising an input layer, an output layer, and a plurality of hidden layers, and wherein the geological data and the first acquired drilling parameter data are inputs to the input layer of the artificial neural network;

determining whether the third drilling cost data of the first drilling fluid exceeds the fourth drilling cost data of the replacement drilling fluid; and transmitting a first command to update the drilling operation by changing a drilling system to use the replacement component in response to determining that the second drilling cost data satisfies the predetermined criterion; and transmitting, to the control system coupled to the mud pump system, a second command that automatically changes the first drilling fluid to the replacement drilling fluid in the drilling operation in response to the third drilling cost data exceeding the fourth drilling cost data.

8. The system of claim 7, further comprising:

a user device coupled to the control system, wherein the user device is configured to provide a graphical user interface for presenting the first drilling cost data and the second drilling cost data.

9. The system of claim 8, wherein the predetermined criterion is a targeted cost-per-foot drilling rate for the drilling operation, and wherein the user device is further configured to:

present the first drilling cost data is worse than the targeted cost-per-foot drilling rate, and obtain a user selection of one or more replacement components in response to presenting the first drilling cost data is worse than the targeted cost-per-foot drilling rate.

10. The system of claim 7, wherein the first acquired drilling parameter data corresponds to a first drill bit operating at a predetermined rate of penetration (ROP), wherein the replacement component is a second drill bit that is different from the first drill bit, and wherein the second drilling cost data corresponds to the second drill bit operating at the predetermined ROP.

11. The system of claim 7, wherein the predetermined criterion corresponds to a predetermined cost-per-length of a first drilling run in a well path, and wherein the well path is produced by the drilling operation using a plurality of drilling runs comprising the first drilling run.

12. The system of claim 7, wherein the automated drilling manager is further configured to:

obtain historical well data for one or more wells at a predetermined distance from the predetermined well, and wherein the drilling cost model uses the historical well data to determine the predetermined criterion.

13. The system of claim 7, wherein the automated drilling manager is further configured to:

determine, based on the drilling cost model, fifth drilling cost data using second acquired drilling parameter data that is obtained in real-time during the drilling operation; and transmit a second command to terminate the drilling operation in response to determining that the fifth drilling cost data fails to satisfy the predetermined criterion.

14. A method, comprising:

obtaining, by an automated drilling manager comprising a computer processor, first acquired drilling parameter data regarding one or more drilling parameters in real-time during a drilling operation for a predetermined well, wherein the drilling operation is performed using a first drilling fluid;

obtaining, by the automated drilling manager, geological data for one or more formations in the predetermined well;

determining, by the automated drilling manager and based on a drilling cost model, first drilling cost data for the first drilling fluid using the first acquired drilling parameter data and the geological data, wherein the first drilling cost data comprises a real-time cost of drilling the predetermined well at a current drilling rate in the drilling operation;

determining, by the automated drilling manager and based on the drilling cost model, the geological data, and the first acquired drilling parameter data, second drilling cost data of a replacement drilling fluid for the drilling operation, wherein the replacement drilling fluid is different from the first drilling fluid, wherein the drilling cost model is an artificial neural network comprising an input layer, an output layer, and a plurality of hidden layers, and wherein the geological data and the first acquired drilling parameter data are inputs to the input layer of the artificial neural network;

determining, by the automated drilling manager, whether the first drilling cost data for the first drilling fluid satisfies a predetermined criterion;

determining, by the automated drilling manager and in response determining that the first drilling cost data fails to satisfy the predetermined criterion, whether the second drilling cost data of the replacement drilling fluid satisfies the predetermined criterion;

transmitting, by the automated drilling manager and to a control system coupled to a mud pump system, a first command that automatically changes the first drilling fluid to the replacement drilling fluid in the drilling operation in response to the second drilling cost data exceeding the first drilling cost data;

obtaining, by the automated drilling manager, second acquired drilling parameter data regarding the one or more drilling parameters in real-time during the drilling operation based on using the replacement drilling fluid for the drilling operation;

determining, by the automated drilling manager and based on the drilling cost model, third drilling cost data based on using the replacement drilling fluid for the drilling operation and the second acquired drilling parameter data; and transmitting, by the automated drilling manager a second command to terminate the drilling operation in response to determining that the third drilling cost data fails to satisfy the predetermined criterion.

* * * * *